US008059822B2

(12) United States Patent
Herzog

(10) Patent No.: US 8,059,822 B2
(45) Date of Patent: Nov. 15, 2011

(54) METHOD AND DEVICE FOR ACTIVELY CORRECTING THE ACOUSTIC PROPERTIES OF AN ACOUSTIC SPACE LISTENING ZONE

(75) Inventor: Philippe Herzog, Roquevaire (FR)

(73) Assignee: Centre National de la Recherche Scientifique, Paris (FR)

( * ) Notice: Subject to any disclaimer, the term of this patent is extended or adjusted under 35 U.S.C. 154(b) by 847 days.

(21) Appl. No.: 12/065,610

(22) PCT Filed: Sep. 4, 2006

(86) PCT No.: PCT/FR2006/050840

§ 371 (c)(1),
(2), (4) Date: May 21, 2008

(87) PCT Pub. No.: WO2007/028922

PCT Pub. Date: Mar. 15, 2007

(65) Prior Publication Data

US 2008/0247552 A1 Oct. 9, 2008

(30) Foreign Application Priority Data

Sep. 5, 2005 (FR) ..... 05 52676

(51) Int. Cl.
*H04R 5/00* (2006.01)

(52) U.S. Cl. ..... 381/1; 381/96; 381/150

(58) Field of Classification Search ..... 381/1, 96, 381/150

See application file for complete search history.

(56) References Cited

U.S. PATENT DOCUMENTS

| | | | | |
|---|---|---|---|---|
| 4,122,303 | A | 10/1978 | Chaplin et al. | |
| 4,899,387 | A | 2/1990 | Pass et al. | |
| 5,537,479 | A * | 7/1996 | Kreisel et al. | 381/96 |
| 5,727,066 | A * | 3/1998 | Elliott et al. | 381/1 |
| 6,795,557 | B1 | 9/2004 | Maekivirta et al. | |
| 7,715,575 | B1 * | 5/2010 | Sakurai et al. | 381/309 |

FOREIGN PATENT DOCUMENTS

| | | |
|---|---|---|
| EP | 0 335 468 A1 | 10/1989 |
| EP | 1 211 668 A1 | 6/2002 |

* cited by examiner

*Primary Examiner* — Cuong Q Nguyen
(74) *Attorney, Agent, or Firm* — Young & Thompson

(57) ABSTRACT

The invention concerns a method and device for actively correcting acoustic properties of a listening zone (27) of an acoustic space (1), comprising means for converting a signal to be reproduced (2, 4) in an acoustic space (1), means for attenuating resonance including at least means for measuring the perturbed sound signal (15), means for processing an electric signal (6) and at least one secondary sound reproduction source (8). The invention is characterized in that the means for measuring the perturbed sound signal (15) are distributed in several predetermined measuring positions (5) in the acoustic space (1), the secondary sound reproduction sources (8) are distributed in several predetermined correcting positions (17) in the acoustic space (1), the resonance attenuating means is coupled with means for processing the signal to be reproduced (3) and the electric signal processing means (6) includes at least one signal controlling means (7) connected to each means for measuring the perturbed sound signal (15).

20 Claims, 4 Drawing Sheets

METHOD AND DEVICE FOR ACTIVELY CORRECTING THE ACOUSTIC PROPERTIES OF AN ACOUSTIC SPACE LISTENING ZONE

The invention relates to a method and device for actively correcting the acoustic properties of a listening zone in an acoustic space.

By listening zone is meant a reduced volume of the acoustic space wherein one or several listeners are liable to be situated for listening to a sound signal.

The reproduction of a sound signal by means of a fixed or mobile installation is perturbed by the limits of this installation (fidelity, quality of the response, dynamics), but also by the acoustic features of the environment wherein it is installed. This leads to two main effects. On the one hand, the signal received at one point is modified by the propagation within the environment (multiple interfering paths, resonance, absorption of certain components), and on the other hand, the reaction of the environment on the sound sources modifies their behaviour (acoustic load detuned, modification of the radiation conditions).

Consequently, a sound reproduction installation which has been designed for operating in a given environment may have highly modified behaviour when used in an environment departing from that for which it has been designed. This problem is raised very frequently in the case of audio reproduction units such as Hi-Fi sets and more particularly when used in small premises such as residential rooms, whereof the current dimensions lead to spurious resonances at low frequencies (in particular in the first eigen modes of the room).

At low frequencies, the reflections of the sound waves against the walls of the room combine to form high (+) and low (−) pressure zones distributed spatially in the room, as represented on FIG. 2. Different distributions of the high (+) and low (−) pressure zones are possible.

These distributions are characteristic of the room. They correspond each to an acoustic mode which resonates at a specific frequency.

By resonance is meant a mode for transmitting sound waves activated by the multiple reflections of these waves against the walls of the acoustic space, producing spatial distribution of the pressure in the acoustic space perturbing sound reproduction in the listening zone.

The influence of the reproduction environment being predominant, numerous solutions has been sought for correcting or limiting it. These solutions may be classified in two general categories. On the one hand, those which aim at modifying the signal before reproducing it so that the reproduction of the modified signal comes loser to the original signal (correction by processing the signal to be reproduced). On the other hand, those which aim at modifying the features of the acoustic environment so as to reduce its influence on the sound reproduction (active acoustic correction for instance).

The correction by processing the signal to be reproduced falls in the first category. It is by far the most widespread. It may be performed by tone balance corrections (high-pitch/low-pitch adjustment, graphic equaliser), finer frequency corrections (parametric equaliser), or by specific processes (digital filtering system adjusted by measuring the response at one or several listening points). The devices of the documents "Modal Equalization of Loudspeaker-Room Responses at Low Frequencies" (J. Audio. Eng. Soc, Vol. 51, No 5, May 3) and "Equalization of Room Acoustics and Adaptive Systems in the Equalization of Small Room Acoustics" (AES, XVth International Conference) use this type of correction.

However, the efficiency of the correction methods by processing the signal to be reproduced is delineated by at least three principle limits.

If the environment exhibits high resonances or anti-resonances, it is not possible to compensate for them by a method for processing the signal to be reproduced.

The influence of the environment being associated with sound propagation, it is highly variable from one point to another in an acoustic space. A correction of the signal may ten only relate to an accurate position in space. An average correction leads to a degradation of the performances of this correction.

The correction method by processing the signal to be reproduced is also limited for a correction of the fine signal which becomes very sensitive to the variations in the sound environment.

The second category of solutions (correction of the acoustic environment) for limiting the influence of the sound reproduction environment is not so easy to implement. It is hence less widespread. The most conventional method consists in a passive acoustic processing for a listening room or a concert hall. The correction must be made in the whole volume, even if the reproduction only relates to a reduced listening zone.

There are also active acoustic correction solutions based on an auxiliary electro-acoustic installation.

The patents FR 2 766 953 and U.S. Pat. No. 4,122,303 are known and divulge this approach for reducing the noise. The patents EP 1 088 298 and EP 0 555 787 divulge a device which enables to modify the acoustic features of an audio space.

These solutions exhibit practical limits. The correction of the very low frequencies requires large-sized devices, whereof the space requirements are often unacceptable, and whereof the performances are limited. The significant number of degree of freedom implies a density of actuators or of sensors which is hardly acceptable in practice. Moreover, the active corrections of the sound environment do not provide a signal reference to perform their processing which limits the choice of the processing algorithms, and often leads to a compromise between the stability and the performances of the processing.

The objective of the present invention is to offer a method and device for actively correcting the acoustic properties of a listening zone in an acoustic space which is more efficient, aiming at providing better homogeneity of the sound signal in a reduced space.

Better homogeneity of the sound signal in the reduced space also implies better frequency homogeneity.

The invention enables to correct which is not correctable by other approaches, with reduced implementation complexity and at reduced cost.

In this view, the invention relates to a method and device for actively correcting the acoustic properties of a listening zone in an acoustic space including:

- a step of converting a signal to be reproduced in an acoustic space producing a primary sound signal causing resonances in the acoustic space, the superimposition of the primary sound signal with the resonances forming a perturbed sound signal,
- a step of attenuating resonances comprising:
  - a step of measuring the perturbed sound signal, said perturbed sound signal being converted into an electrical signal,
  - a step of processing the electrical signal forming a processed electrical signal,
  - a step of converting by at least one secondary sound reproduction source said processed electrical signal in a secondary sound signal capable of attenuating said resonances for obtaining a corrected sound signal.

According to the method of the invention:

the step of measuring the perturbed sound signal includes several predetermined measuring positions in the acoustic space, so as to measure resonance amplitudes close to those of the resonances perturbing the reproduction of the primary sound signal in the listening zone, the secondary sound signal attenuating the resonances is reproduced in several predetermined correcting positions in the acoustic space, so as to act in reverse direction on said resonances enabling to obtain a homogeneous corrected sound signal in the listening zone, the step of attenuating the resonances is coupled with a step of processing the signal to be reproduced so as to enable the generation of a modified sound signal capable of minimising the formation of the resonances, the step of processing the electrical signal takes into account all the perturbed sound signals measured at the different measuring positions.

In different possible embodiments, the present invention also relates to the features which will appear in the following description and which should be considered individually or in all their technically possible combinations:

the processing of the signal to be reproduced is a signal processing by equalisation, the processing of the electrical signal and the processing of the signal to be reproduced use the signal to be reproduced as a reference, the step of processing the electrical signal includes a step of allocating coefficients weighting said coefficients according to the measuring position.

The invention also relates to a device for actively correcting the acoustic properties of a listening zone in an acoustic space including:

a means for converting a signal to be reproduced in an acoustic space producing a primary sound signal causing resonances in the acoustic space, the superimposition of the primary sound signal with the resonances forming a perturbed sound signal, a means for attenuating resonances comprising:

at least one means for measuring the perturbed sound signal, said perturbed sound signal being converted into an electrical signal, a means for processing the electrical signal enabling the formation of a processed electrical signal, at least one secondary sound reproduction source converting said processed electrical signal in a secondary sound signal capable of attenuating said resonances for obtaining a corrected sound signal.

According to the device of the invention:

the means for measuring the perturbed sound signal are distributed in several predetermined measuring positions in the acoustic space, so as to measure the resonance amplitudes close to those of the resonances perturbing the reproduction of the primary sound signal in the listening zone, the secondary sound reproduction sources converting said processed electrical signal in a secondary sound signal are distributed in several predetermined correcting positions in the acoustic space, so as to act in reverse direction on said resonances enabling to obtain a homogeneous corrected sound signal in the listening zone, the means for attenuating the resonances is coupled with a means for processing the signal to be reproduced so as to enable the generation of a modified sound signal capable of minimising the formation of the resonances, the means for processing the electrical signal includes at least one signal controlling means 7 connected to each means for measuring the perturbed sound signal.

In different possible embodiments, the present invention also relates to the features which will appear in the following description and which should be considered individually or in all their technically possible combinations:

the means for processing the signal to be reproduced is a signal processing means by equalisation, the means for attenuating the resonances and the means for processing the signal to be reproduced use the signal to be reproduced as a reference, the signal controlling means includes a step of allocating coefficients weighting said coefficients according to the measuring position, each signal controlling means includes a single path connected to a secondary sound reproduction source, said secondary sound reproduction source converting the processed electrical signal in a secondary sound signal attenuating at least one resonance, the signal controlling means includes a control filter, the control filter is an adaptive filter, the means for measuring the perturbed sound signal are arranged in the listening zone, the means for measuring the perturbed sound signal are arranged at the periphery of the acoustic space.

The invention will be described more in detail with reference to the appended drawings wherein:

FIG. 1 represents a device for actively correcting the acoustic properties of an acoustic space according to the previous art.

Figure 1:
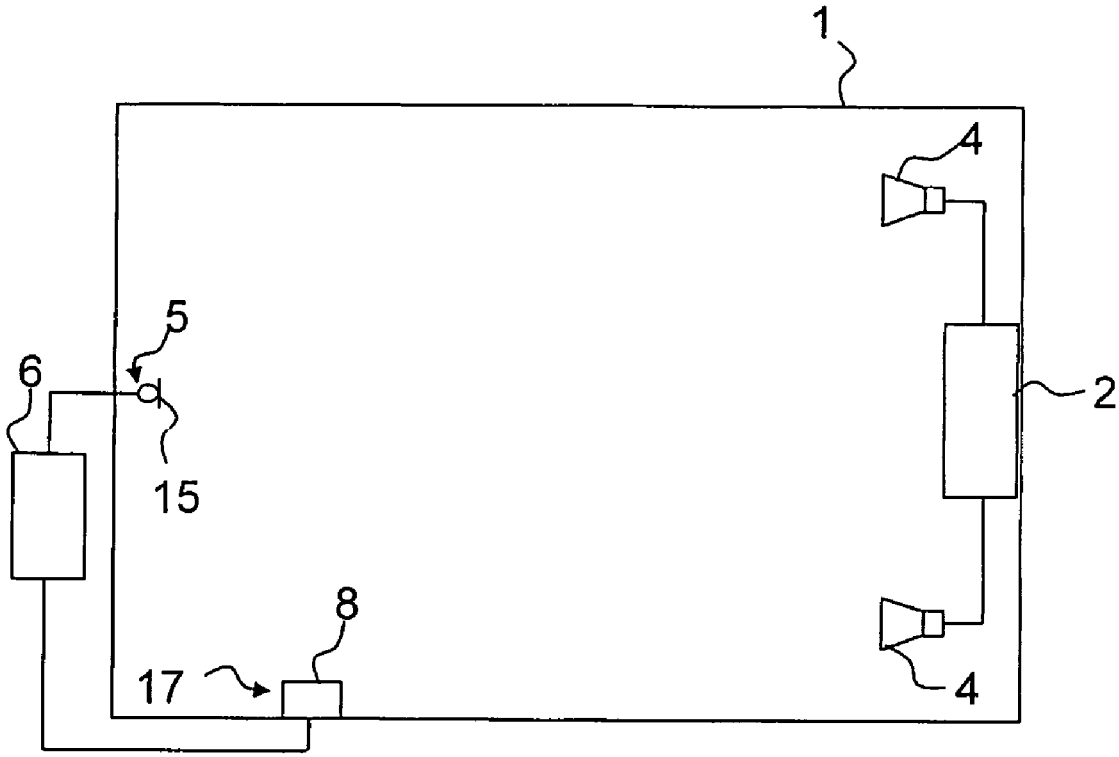
Prior Art FIGURE 1
FIG. 1 represents an example of a device for actively correcting the acoustic properties of an acoustic space according to the previous art.

This device is placed in an acoustic space 1, usually small-sized such as a residential room. It comprises a means for reproducing a primary sound signal 2, 4 comprising a unit for reproducing a primary sound signal 2 associated with at least two reproduction sources of a primary sound signal 4. The reproduction means 2, 4 may consist of a household Hi-Fi set fitted with two loudspeakers.

Both reproduction sources of a primary sound signal 4 and the listening zone 27 are advantageously arranged as a stereo triangle in the acoustic space 1 as recommended by the manufacturers.

The reproduction means 2, 4 converts the signal to be reproduced so as to generate a primary sound signal. The signal to be reproduced is an electrical signal derived from a pre-recording on a compact disc for instance.

The primary sound signal causes resonances in the acoustic space 1. The superimposition of the primary sound signal with the resonances forms a perturbed sound signal.

A means for attenuating the resonances enables to limit the influence of the acoustic space 1 on the reproduction of the sound. This means is called commonly a device for active acoustic correction of the sound environment.

It includes at least one measuring means 15 of the perturbed sound signal which may be a microphone or a pressure sensor for instance.

The perturbed sound signal is converted into an electrical signal 32, treated by a means for processing the electrical signal 6. A processed electrical signal 9 is obtained.

At least one secondary sound reproduction source 8 converts the processed electrical signal 9 in a secondary sound signal exciting the resonances so as to attenuate them and obtain a corrected sound signal.

The secondary sound reproduction sources 8 may be for instance loudspeakers.

The resonances of the perturbed sound signal are coupled with the amplitudes of the secondary sound signal. The result is a corrected sound signal with fewer resonances. Nevertheless, the listener does not perceive the same corrected sound signal in all the points of the acoustic space 1. The spatial and hence frequency distribution corrected sound signal are not homogeneous.

Figure 2:
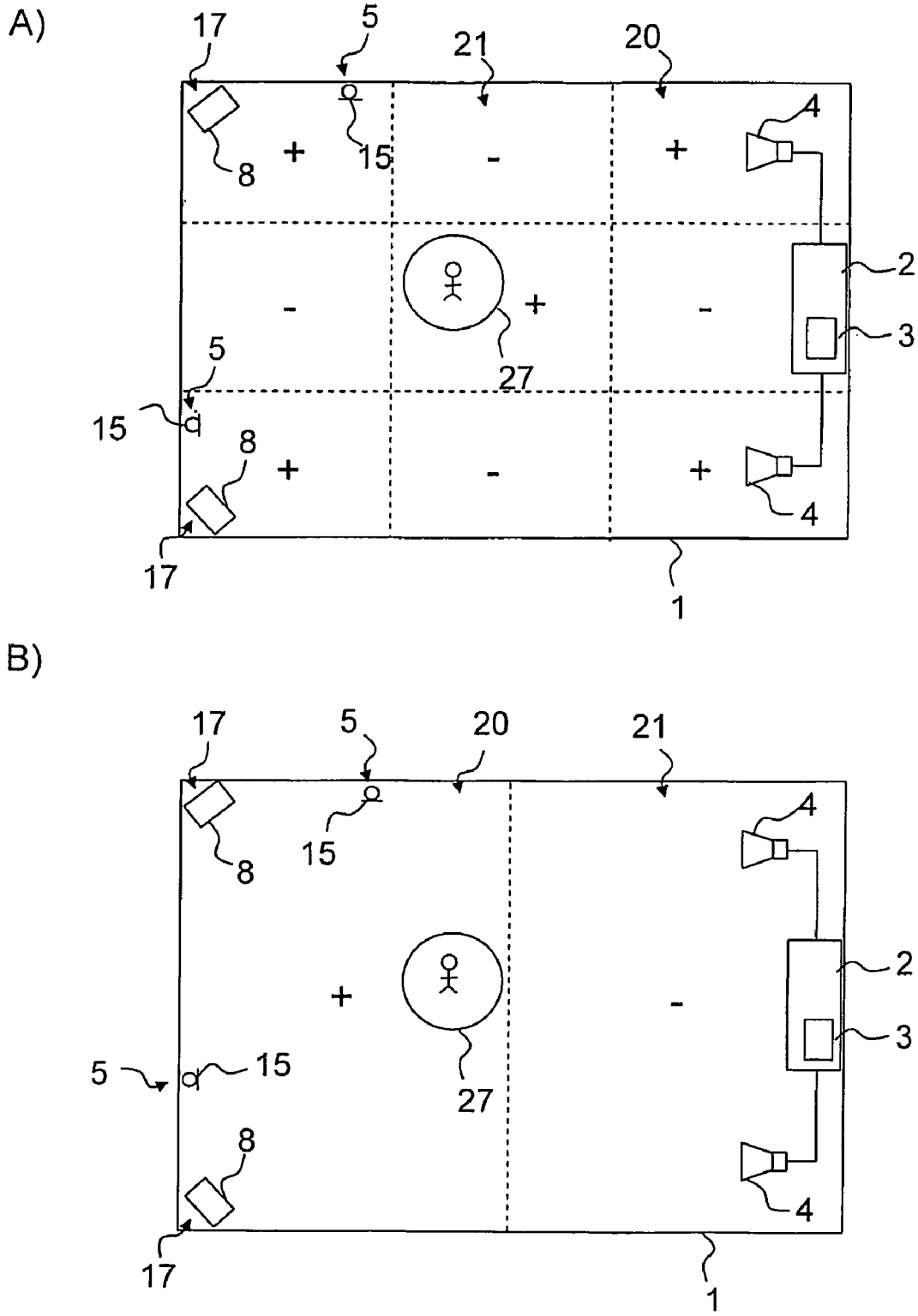
FIG. 2 is a diagrammatic representation of a device for actively correcting the acoustic properties of an acoustic space correcting, for instance, both acoustic modes (2,2) A) and (1,0) B) present in a listening zone, according to an embodiment of the invention.
Figure 3:
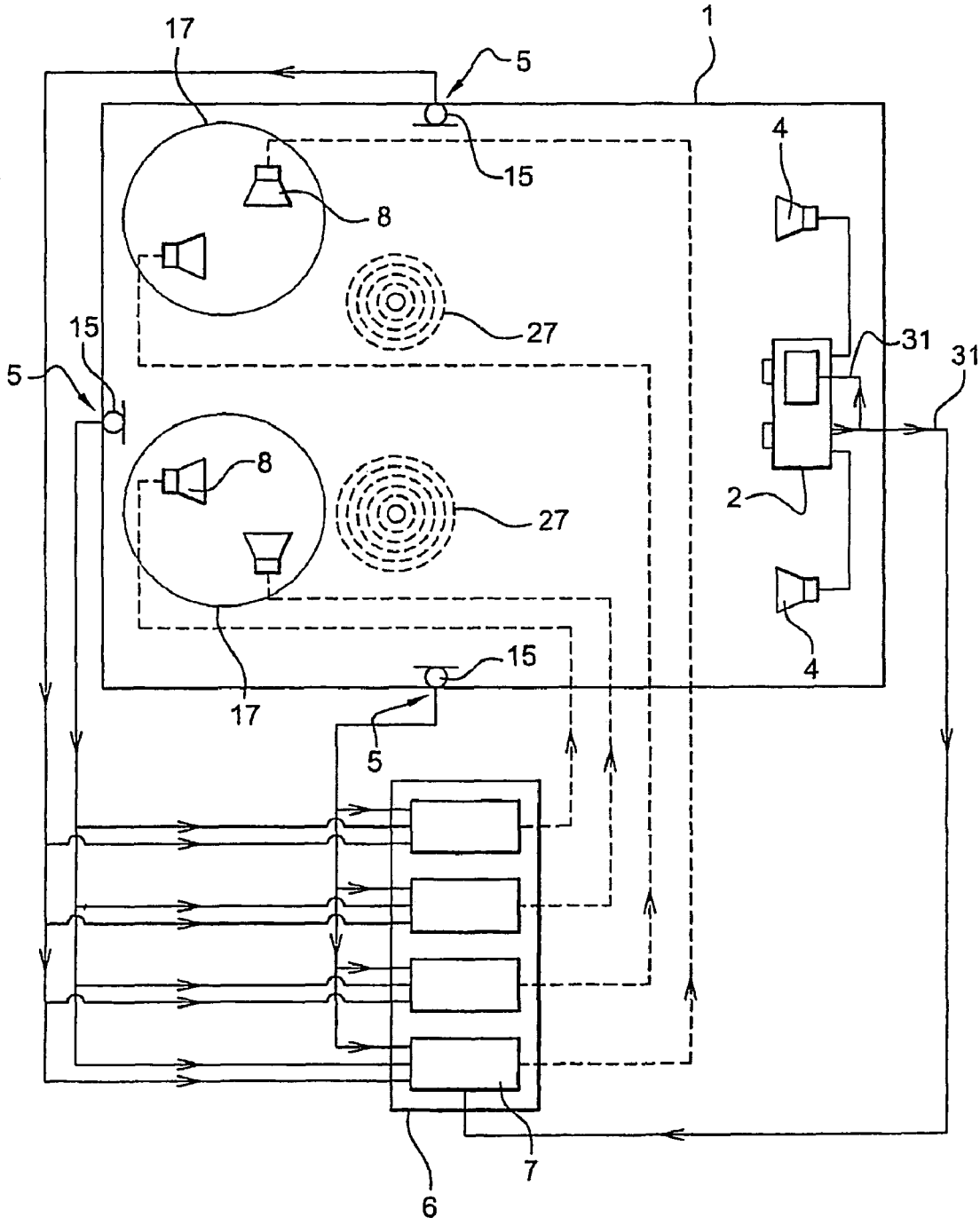
FIG. 3 is a more detailed diagrammatic representation of the device for actively correcting the acoustic properties of an acoustic space according to an embodiment of the invention.

FIGS. 2 and 3 represent an example of device actively correcting the sound environment according to the invention.

The means for attenuating the resonances is coupled with a means for processing the signal to be reproduced 3. The means for processing the signal to be reproduced 3 produces a modified sound signal capable of minimising the formation of the resonances.

The processing of the signal to be reproduced may be a processing of the signal to be reproduced by equalisation for instance.

The processing of the signal to be reproduced enables to perform a processing of the signal before it is reproduced by the primary sound reproduction sources 4.

The use of a means for attenuating the resonances enables to obtain more efficient processing of the signal to be reproduced.

The means for attenuating the resonances and the means for processing the signal to be reproduced 3 use the signal to be reproduced as a reference 31.

The measuring means 15 are distributed in several predetermined measuring positions 5 in the acoustic space 1 so as to enable the detection of all the resonances and more accurately of all the first eigen modes of the acoustic space 1 disturbing the sound reproduction in the listening zone 27.

The means for measuring the perturbed sound signal 15 may be arranged at positions where the amplitudes produced by the resonances are identical to those present in the listening zone 27.

The means for measuring the perturbed sound signal 15 may be arranged in the listening zone 27.

The measuring means 15 measure at least one of the parameters of at least one of the first eigen modes of the acoustic space 1. The measured parameter may be the high gain in amplitude. The gain may be represented by a matrix defined by two indices, one is dedicated to a measuring position 5 and the other to an eigen mode.

These parameters may be measured, as explained previously, in a listening zone 27 where the first eigen modes are particularly emergent and also in a frequency range wherein the first eigen modes are particularly disturbing.

In a particular embodiment the measuring means 15 may be arranged along walls of the acoustic space 1, approximately every 50 cm for instance.

In another embodiment, the means for measuring 15 may be distant from the listening zone 27.

FIG. 2 gives an example of the positioning of the measuring means 15 which are provided at predefined positions 5. These positions 5 are predefined by noting beforehand the amplitudes produced by the disturbing resonances in the listening zone 27. On FIG. 2, two modes are represented, the mode (2,2) (FIG. 2A) and the mode (1,0) (FIG. 2B). They lead to two different pressure distributions in space. High pressure zones 20 are separated par low pressure zones 21.

According to the record, both these modes are detected as present in the listening zone 27 and both generate a high pressure zone 20 in this listening zone 27.

The record will hence be carried on so as to detect other positions of the acoustic space exhibiting similar high pressure zones 20. More accurately, sound signals are sought with amplitudes, at the resonance frequencies, close to those present in the listening zone 27 at the same frequencies. By close is meant amplitudes showing the same sign. A resonance map of the acoustic space 1 is thereby provided.

Then the measuring means 15 are placed at the positions which exhibit the same high pressure zones 20 as the listening zone 27.

As represented on FIG. 3, the measuring means 15 are connected to a means for processing the electrical signal 6. More accurately, each means for processing the perturbed signal 15 is connected to at least one signal controlling means 7 of the means for processing the electrical signal 6. The step of processing the electrical signal takes into account all the perturbed sound signals measured at the different measuring positions 5. This implies that the signal controlling means 7 is multichannel and that the processing of the electrical signal is of matrix type. Each secondary sound signal 9 at output of each signal controlling means 7 depends on all the perturbed sound signals measured. In another words, all the outputs depend on all the inputs.

Each signal controlling means 7 processes one or several resonances (modes) at once.

Figure 4:
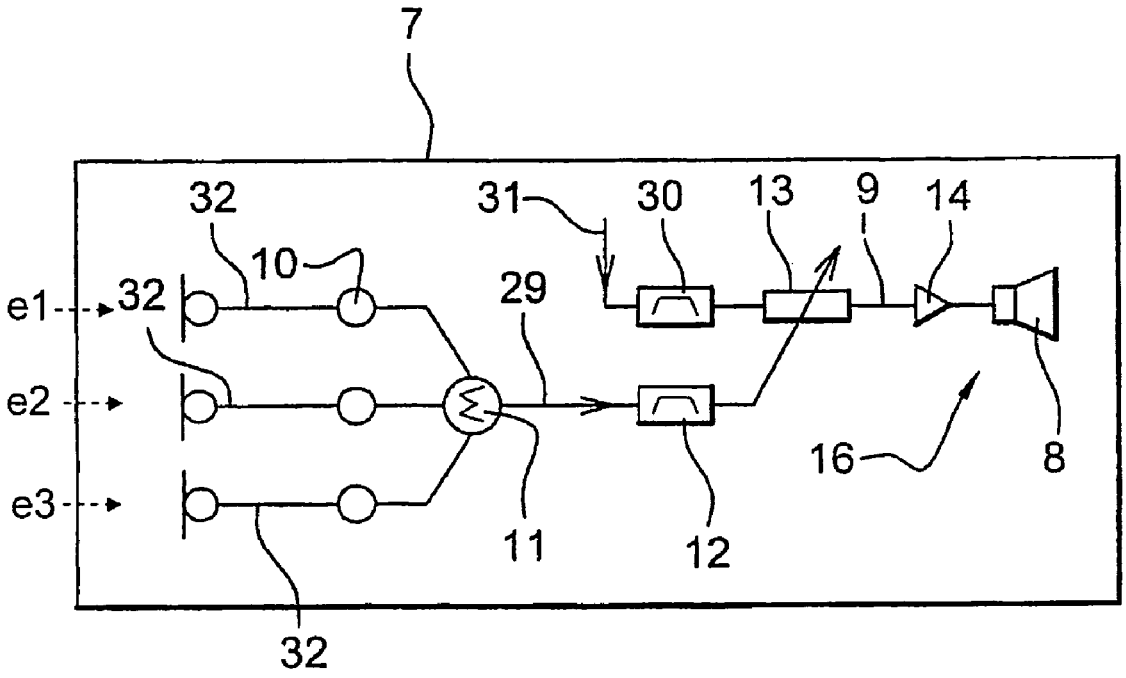
FIG. 4 is a diagrammatic representation of a means for processing the electrical signal.

Each signal controlling means 7, represented on FIG. 4, comprises a means for allocating coefficients 10 corresponding to each position of a means for measuring the perturbed sound signal 5.

Coefficients are allocated to the gains, for instance, and are weighted according to the measuring position 5.

For a given eigen mode, the coefficient is weighted according to the influence of this mode on the primary sound signal at the measuring position 5.

The amplitudes of the gains are then summed in a summation means 11 so as to obtain an error signal 29. The error signal 29 and the reference signal 31 are filtered by a filter 12 and 30 respectively so as to isolate the frequencies close to the resonance frequency considered.

In a particular embodiment, the processing of the electrical signal includes a step of combining of the perturbed sound signals measured by the measuring means of the perturbed signal 15. This step consists in conducting systematically a difference between the weighted inputs, i.e. between the perturbed sound signals measured and weighted by the coefficient allocating means 10.

Let us consider as an example the signal controlling means 7 of FIG. 4 which includes three inputs each, allocated to a perturbed sound signal measured. These inputs are numbered e1, e2 and e3. A difference is carried out between the perturbed sound signals measured and weighted. The following difference signals are obtained: e1-e2, e2-e3 and e3-e1. These difference signals correspond in fact to pressure differences between the various measuring positions 5. These difference signals are then summed by the summation means 11 so as to obtain the error signal 29.

This combination step improves the performances of the correction device since the difference signals are more characteristic of the resonances than the pressures on their own.

In another embodiment, both the difference signals and the perturbed sound signals measured and weighted are used in the step of processing the electrical signal. When adjusting the signal controlling means 7, the proportion of these both types of signals to be considered are determined in the step of processing the electrical signal.

A control filter 13 including an algorithm enables to obtain at its output a processed electrical signal 9 which is then amplified by an amplifier 14 before being converted in a secondary sound signal by the loudspeaker 8. At a given resonance frequency, the secondary sound signal exhibits amplitudes in phase opposition relative to those of the resonances.

By coupling, the amplitudes are attenuated. A corrected sound signal is obtained which does not exhibit or hardly exhibits any resonances in the listening zone 27.

The parameters of the algorithm may be determined beforehand during the installation of the device for actively correcting the acoustic properties in the acoustic space 1.

It is possible to use an adaptive control filter 13 using, for instance, an LMS (Least Mean Squares) type algorithm.

Taking into account the unavoidable fluctuations of the acoustic environment to be corrected, the signal controlling means 7 must adapt thereto in real time.

This may also be obtained by the measurement of magnitudes (example the temperature) used for modifying the parameters of the algorithm.

Each signal controlling means 7 includes a path 16 connected to a secondary source 8.

Each channel may process several modes simultaneously.

The correcting positions 17 are predetermined so that the amplitudes produced by the secondary sources 8 enable good coupling with the modes to be treated while limiting the coupling with the other modes in the listening zone 27. The frequency density and the dampening effects are then regulated. The effects obtained are a better homogeneity of the frequency and space responses in the listening zone 27, and a shorter time response. This approach consists in providing spatial correction to obtain a frequency correction.

In a particular embodiment, the secondary sources 8 may be placed in the corners of the acoustic space 1.

The correction is performed in a reduced portion of the space corresponding to the position of one or several listeners and more accurately of the listeners' ears. They may be remote from the primary sound reproduction sources 4. Their position is selected so as to energise the disturbing resonances.

In another embodiment, it is also possible to apply this correction in several listening zones 27.

In another embodiment, the primary sound reproduction sources 4 are used for attenuating the disturbing resonances.

In another embodiment, an exchange of information between the signal controlling means 7 and the means for processing the signal to be reproduced 3 is possible.

Thus, the method and the device for actively correcting the acoustic properties offered enable to obtain more efficient sound reproduction in a listening zone 27 thanks to better pressure distribution in this listening zone 27, causing better frequency distribution of the sound waves.

This method is based upon a modal approach. The purpose is to process all the modes at the same time.

The invention enables to correct which is not correctable by other approaches, with reduced implementation complexity and at reduced cost.

The invention claimed is:

1. A method for actively correcting the acoustic properties of a listening zone (27) of an acoustic space (1) including:

a step of converting a signal to be reproduced in an acoustic space (1) producing a primary sound signal causing resonances in the acoustic space (1), the superimposition of the primary sound signal with the resonances forming a perturbed sound signal, a step of attenuating resonances comprising:

a step of measuring the perturbed sound signal, said perturbed sound signal being converted into an electrical signal (32), a step of processing the electrical signal (32) forming a processed electrical signal (9), a step of converting by at least one secondary sound reproduction source (8) said processed electrical signal (9) into a secondary sound signal capable of attenuating said resonances to obtain a corrected sound signal, characterised in that:

the step of measuring the perturbed sound signal includes several measuring positions (5) predetermined in the acoustic space (1) so as to measure resonance amplitudes close to those of the resonances perturbing the reproduction of the primary sound signal in the listening zone (27), the secondary sound signal attenuating the resonances is reproduced in several correcting positions (17) predetermined in the acoustic space (1) so as to act in reverse direction on said resonances enabling to obtain a homogeneous corrected sound signal in the listening zone (27), the step of attenuating the resonances is coupled with a step of processing the signal to be reproduced so as to enable the generation of a modified sound signal capable of minimising the formation of the resonances, the step of processing the electrical signal takes into account all the perturbed sound signals measured at the different measuring positions (5).

2. A method for acoustic correction according to claim 1, characterised in that the processing of the signal to be reproduced is a signal processing by equalisation.

3. A method for acoustic correction according to claim 1, characterised in that the processing of the electrical signal and the processing of the signal to be reproduced use the signal to be reproduced as a reference (31).

4. A method for acoustic correction according to claim 1, characterised in that the step of processing the electrical signal includes a step of allocating coefficients weighting said coefficients according to the measuring position (5).

5. A method for acoustic correction according to claim 2, characterised in that the processing of the electrical signal and the processing of the signal to be reproduced use the signal to be reproduced as a reference (31).

6. A method for acoustic correction according to claim 2, characterised in that the step of processing the electrical signal includes a step of allocating coefficients weighting said coefficients according to the measuring position (5).

7. A device for actively correcting the acoustic properties of a listening zone (1) of an acoustic space including:

a means for converting a signal to be reproduced (2, 4) in an acoustic space (1) producing a primary acoustic signal causing resonances in the acoustic space (1), the superimposition of the primary sound signal with the resonances forming a perturbed sound signal, a step for attenuating resonances comprising:

at least one means for measuring the perturbed sound signal (15), said perturbed sound signal being converted into an electrical signal (32), a means for processing the electrical signal (6) enabling the formation of a processed electrical signal (9), at least one secondary sound reproduction source (8) converting said processed electrical signal (9) into a secondary sound signal capable of attenuating said resonances to obtain a corrected sound signal, characterised in that:

the means for measuring the perturbed sound signal (15) are distributed in several measuring positions (5) predetermined in the acoustic space (1) so as to measure resonance amplitudes close to those of the resonances perturbing the reproduction of the primary sound signal in the listening zone (27), the secondary sound reproduction sources (8) converting said processed electrical signal (9) in a secondary sound signal are distributed in several correcting positions (17) predetermined in the acoustic space so as to act in reverse direction on said resonances enabling to obtain a homogeneous corrected sound signal in the listening zone (27), the step of attenuating the resonances is coupled with a step of processing the signal to be reproduced (3) so as to enable the generation of a modified sound signal capable of minimising the formation of resonances, the means for processing the electrical signal (6) includes at least one signal controlling means (7) connected to each means for measuring the perturbed sound signal (15).

8. A device for acoustic correction according to claim 7, characterised in that the processing of the signal to be reproduced (3) is a means for processing the signal by equalisation.

9. A device for acoustic correction according to claim 7, characterised in that the means for attenuating the resonances and the means for processing the signal to be reproduced (3) use the signal to be reproduced as a reference (31).

10. A device for acoustic correction according to claim 9, characterised in that the signal controlling means (7) comprises a means for allocating coefficients (10) weighting said coefficients according to the measuring position (5).

11. A device for acoustic correction according to claim 9, characterised in that each signal controlling means (7) includes a path (16) connected to a single secondary sound reproduction source (8), said secondary sound reproduction source (8) converting the processed electrical signal (9) in a secondary sound signal attenuating at least one resonance.

12. A device for acoustic correction according to claim 9, characterised in that the signal controlling means (7) comprises a control filter (13).

13. A device for acoustic correction according to claim 12, characterised in that the control filter (13) is an adaptive filter.

14. A device for acoustic correction according to claim 7, characterised in that the means for measuring the perturbed sound signal (15) are arranged in the listening zone (27).

15. A device for acoustic correction according to claim 7, characterised in that the means for measuring the perturbed sound signal (15) are arranged at the periphery of the acoustic space (1).

16. A device for acoustic correction according to claim 8, characterised in that the means for attenuating the resonances and the means for processing the signal to be reproduced (3) use the signal to be reproduced as a reference (31).

17. A device for acoustic correction according to claim 10, characterised in that each signal controlling means (7) includes a path (16) connected to a single secondary sound reproduction source (8), said secondary sound reproduction source (8) converting the processed electrical signal (9) in a secondary sound signal attenuating at least one resonance.

18. A device for acoustic correction according to claim 10, characterised in that the signal controlling means (7) comprises a control filter (13).

19. A device for acoustic correction according to claim 11, characterised in that the signal controlling means (7) comprises a control filter (13).

20. A device for acoustic correction according to claim 8, characterised in that the means for measuring the perturbed sound signal (15) are arranged in the listening zone (27).

* * * * *